US011578539B2

(12) United States Patent
Stark

(10) Patent No.: US 11,578,539 B2
(45) Date of Patent: Feb. 14, 2023

(54) DISSOLVABLE CONNECTOR FOR DOWNHOLE APPLICATION

(71) Applicant: Halliburton Energy Services, Inc., Houston, TX (US)

(72) Inventor: Daniel J. Stark, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/467,652

(22) PCT Filed: Jan. 9, 2017

(86) PCT No.: PCT/US2017/012780
§ 371 (c)(1),
(2) Date: Jun. 7, 2019

(87) PCT Pub. No.: WO2018/128636
PCT Pub. Date: Jul. 12, 2018

(65) Prior Publication Data
US 2020/0190914 A1 Jun. 18, 2020

(51) Int. Cl.
*E21B 17/02* (2006.01)

(52) U.S. Cl.
CPC ..... *E21B 17/02* (2013.01); *E21B 17/028* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,805,197 | B2 | 10/2004 | Brumley et al. | |
| 7,114,563 | B2 | 10/2006 | Rose | |
| 7,168,494 | B2 | 1/2007 | Starr et al. | |
| 7,775,286 | B2 * | 8/2010 | Duphorne ..... | E21B 34/063 166/376 |
| 8,540,021 | B2 | 9/2013 | McCarter et al. | |

(Continued)

OTHER PUBLICATIONS

PCT International Search Report and Written Opinion issued for PCT application No. PCT/US2017/012780 dated Oct. 26, 2017, 12 pages.

(Continued)

*Primary Examiner* — Cathleen R Hutchins
*Assistant Examiner* — Ronald R Runyan
(74) *Attorney, Agent, or Firm* — Kilpatrick Townsend & Stockton LLP

(57) ABSTRACT

A dissolvable connector allows a wireline or similar conveyance to be detached from a downhole tool or device based on conditions in a downhole environment instead of an external action, such as application of tension or an electrical pulse. The dissolvable connector can be strategically positioned to allow retrieval of expensive tools and equipment that are located above the connector. A protective sheath may be provided around the dissolvable connector that opens or unsheathes based on conditions in the downhole environment (e.g., pressure, temperature), a telemetry signal (e.g., from the surface or from a tool string), or tension, to provide greater control over the timing of the release of the dissolvable connector. Such a dissolvable connector allows the device to be detached from the conveyance without the need for wire-cutting operations or weak-point breaking operations.

18 Claims, 6 Drawing Sheets

(56) References Cited

U.S. PATENT DOCUMENTS

| | | | | |
|---|---|---|---|---|
| 8,839,869 | B2 * | 9/2014 | Porter | E21B 33/128 166/181 |
| 2004/0216887 | A1 * | 11/2004 | Bertelsen | E21B 17/06 166/377 |
| 2009/0044957 | A1 | 2/2009 | Clayton et al. | |
| 2011/0048743 | A1 | 3/2011 | Stafford et al. | |
| 2011/0056702 | A1 | 3/2011 | Sharma et al. | |
| 2011/0067889 | A1 | 3/2011 | Marya et al. | |
| 2011/0259601 | A1 | 10/2011 | Withers | |
| 2013/0020084 | A1 | 1/2013 | Goodson | |
| 2013/0160992 | A1 | 6/2013 | Agrawal et al. | |
| 2013/0168083 | A1 | 7/2013 | McCarter et al. | |
| 2013/0312982 | A1 | 11/2013 | O'Connor et al. | |
| 2013/0333901 | A1 | 12/2013 | Melenyzer | |
| 2014/0251641 | A1 | 9/2014 | Marya et al. | |
| 2014/0311752 | A1 | 10/2014 | Streich et al. | |
| 2018/0216431 | A1 * | 8/2018 | Walton, III | E21B 33/128 |

OTHER PUBLICATIONS

"Cable Safe-Release Tool"; Halliburton, 2014, 2 pages.
"Halliburton Introduces the Illusion Frac Plug"; Halliburton, Jan. 31, 2020, 2 pages.
"Infinity: Dissolvable Plug-and-Perf System"; Schlumberger, 2017, 2 pages, slb.com/Infinity.
Isaac Aviles, SPE, Michael Dardis, SPE, and Gregoire Jacob, SPE; "Dissolvable Plug and Pert System Eliminates Mill-Outs in Multi-stage Stimulations"; Schlumberger, Jun. 1, 2015, 5 pages.

* cited by examiner

DISSOLVABLE CONNECTOR FOR DOWNHOLE APPLICATION

TECHNICAL FIELD

The present disclosure relates generally to devices for use in a wellbore in a subterranean formation and, more particularly, to a dissolvable connector that is capable of selectively disconnecting the device from other tools and equipment based upon exposure to the downhole environment.

BACKGROUND

Exploring, drilling and completing hydrocarbon and other wells are generally complicated, time consuming and ultimately very expensive endeavors. In recognition of these expenses, added emphasis has been placed on efficiencies associated with tool deployment and delivery in a downhole environment. Over the years, ever increasing well depths and sophisticated well architecture have made reductions in the time and effort spent in completions and maintenance operations of even greater focus.

Several downhole applications require the release of a cable or a tool in a downhole environment. The mechanisms responsible for releasing the cable or tool typically require telemetry actuation, wire-cutting operations, weak-point breaking operations, or the like. For example, the release may be accomplished through the use of an electrical pulse to trigger an explosive charge or open a mechanical latch. The release may also be accomplished by placing a device in tension to actuate the release. An example of the latter is the Cable Safe-Release tool (CSR) from Halliburton Energy Services, Inc., which can release a wireline from a stuck logging or perforating string without the need to conduct risky cutting operations.

While existing release mechanisms may be suitable for their intended purposes, there is a need in the art for a release mechanism that is based on environmental conditions in the wellbore and not based on an external action, such as application of tension, an electrical pulse, or costly wire-cutting operations. Such a system would allow safe release of tools and equipment downhole without the need for telemetry, wire-cutting operations, or weak-point breaking operations.

BRIEF DESCRIPTION OF THE DRAWINGS

The features and advantages of certain embodiments will be more readily appreciated when considered in conjunction with the accompanying figures. The figures are not to be construed as limiting any of the preferred embodiments.

DETAILED DESCRIPTION

Figure 1:
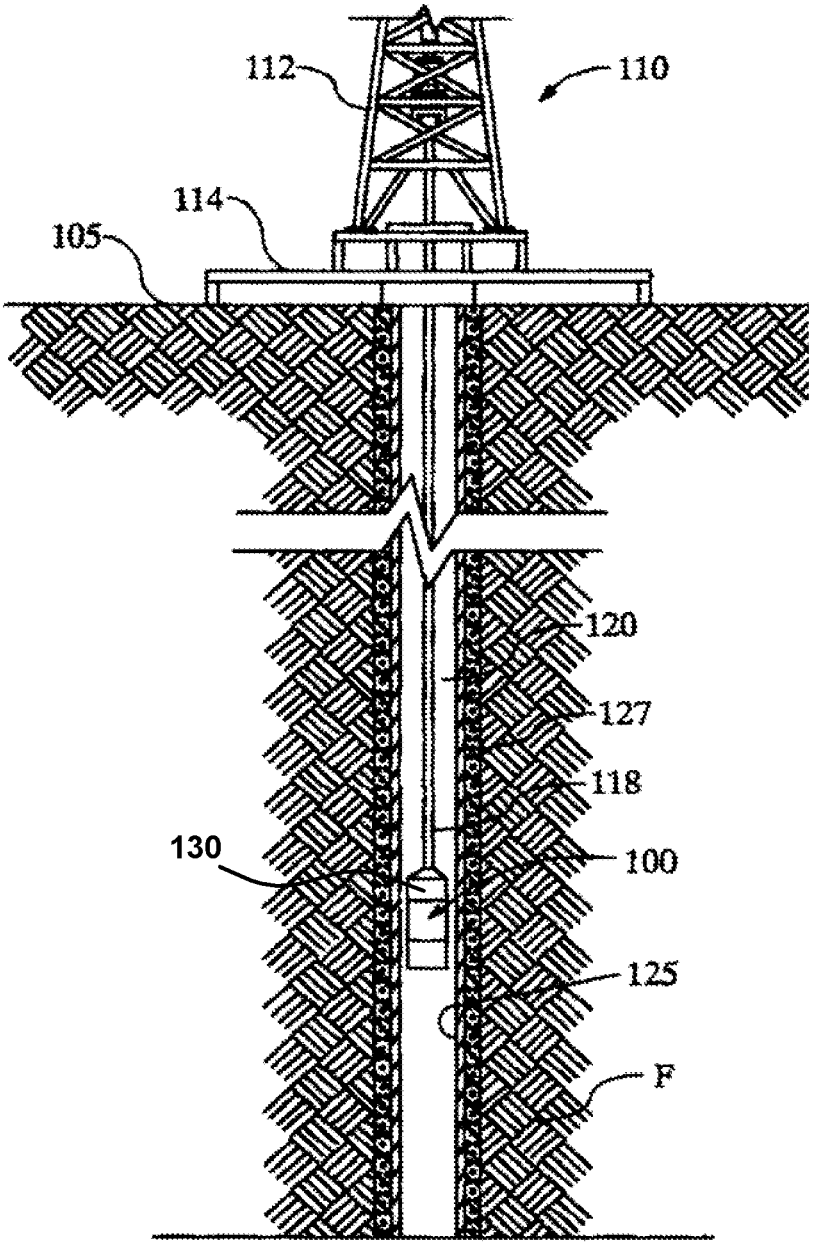
FIG. 1 illustrates an exemplary well in which an exemplary dissolvable connector may be used according to the disclosed embodiments.

The following discussion is presented to enable a person skilled in the art to make and use the exemplary disclosed embodiments. Various modifications will be readily apparent to those skilled in the art, and the general principles described herein may be applied to embodiments and applications other than those detailed below without departing from the spirit and scope of the disclosed embodiments as defined herein. Accordingly, the disclosed embodiments are not intended to be limited to the particular embodiments shown, but are to be accorded the widest scope consistent with the principles and features disclosed herein.

As used herein, the words "comprise," "have," "include," and all grammatical variations thereof are each intended to have an open, non-limiting meaning that does not exclude additional elements or steps. It should also be understood that, as used herein, "first," "second," "third," etc., are arbitrarily assigned and are merely intended to differentiate between two or more layers, materials, etc., as the case may be, and does not indicate any particular orientation or sequence. Furthermore, it is to be understood that the mere use of the term "first" does not require that there be any "second," and the mere use of the term "second" does not require that there be any "third," and so on.

Turning now to the detailed description, the embodiments disclosed herein provide a dissolvable connector that operates (i.e., dissolves) based on conditions in the downhole environment instead of an external action, such as application of tension or an electrical pulse. The dissolvable connector allows a wireline or similar conveyance to be detached from any device or tool attached thereto without the need for telemetry, wire-cutting operations, or weak-point breaking operations. Such a dissolvable connector can be strategically positioned to allow retrieval of expensive tools and equipment that are located above the connector. Additionally, in some embodiments, a protective sheath may be provided around the dissolvable connector that opens or unsheathes based on conditions in the downhole environment (e.g., pressure, temperature), a telemetry signal (e.g., from the surface or from a tool string), or tension, to provide greater control over the timing of the release of the dissolvable connector.

The term "dissolvable" is used herein to refer to materials that are capable of being dissolved either entirely or at least partially, as in the case of certain compositions that include both dissolvable and non-dissolvable components.

The dissolvable connector is particularly useful in releasing isolation devices and similar downhole tools. Examples of isolation devices include frac plugs, cement plugs, set packers, and the like. Examples of other downhole tools include electric submersible pumps, a perforating gun, a gravel pack screen, a bottom-hole assembly, fishing equipment, and the like. The dissolvable connector forms a dissolvable connection between the downhole tool or device and the conveyance that conveyed the downhole tools or devices down the well. After certain environmental conditions and/or exposure time (e.g., to specific chemicals, water, or high levels of hydrogen, temperature, pressure, or combination thereof) in the well are met, the connector dissolves, thereby releasing the downhole tools or devices and allowing the conveyance and anything still connected thereto to be retrieved and reused. Such a dissolvable connector allows electrical signal-capable conveyances, such as wireline, e-line, coiled tubing, cable tubing, production tubing, casing string, drill string, fiber cable, and the like, as well as conveyances that do not normally carry electrical signals, such as conventional cable, slickline, and the like, to be used to convey the downhole tool or device.

As understood by those skilled in the art, a well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

Turning to the figures, FIG. 1 depicts an exemplary operating environment for a downhole tool 100 in accordance with the disclosed embodiment. As shown, a drilling rig 110 is positioned on the earth's surface 105 over a wellbore 120 that extends into a subterranean formation F for recovering hydrocarbons. While the drilling rig 110 is illustrated as being used with a land based well, the embodiments disclosed herein could also be used with offshore wells, in which case the rig 110 could be suspended above the wellbore 120. In the depicted example, the upper portion of the wellbore 120 is lined with a casing 125 that is cemented into position against the formation F in a conventional manner using cement 127. In other embodiments, instead of a cased completion as shown, the wellbore 120 can be an open-hole completion.

The drilling rig 110 includes a derrick 112 and a rig floor 114 through which a tubing string 118, which may be a jointed pipe or coiled tubing string, extends downwardly from the drilling rig 110 into the wellbore 120. The drilling rig 110 is a conventional drilling rig and therefore includes a motor driven winch and other associated equipment for extending the tubing string 118 into the wellbore 120 to position the downhole tool 100 at the desired depth. Alternatively, instead of the tubing string 118, a wireline may be used in some embodiments to position the downhole tool 100 within the wellbore 120. The downhole tool 100 may comprise a packer, bridge plug, tubing plug, straddle packer, fracturing plug, cement plug, or other type of wellbore zonal isolation device.

While the exemplary downhole environment of FIG. 1 depicts a stationary drilling rig 110 for lowering and setting the downhole tool 100 within the wellbore 120, one of ordinary skill in the art will readily appreciate that instead of a drilling rig 110, mobile workover rigs, well servicing units, coil tubing rigs, wireline rigs, and the like, may be used to lower the tool 100 into the wellbore 120.

In accordance with the disclosed embodiments, the downhole tool 100 may have, or may include a dissolvable connector 130 that connects the tool 100 to the tubing string 118 (or wireline or other conveyance). The dissolvable connector 130 allows the tool 100 to be released from the tubing string 118 based on the conditions of the downhole environment instead of an external action (e.g., application of tension, electrical pulse, etc.). Such a dissolvable connector 130 allows the tubing string 118 (or wireline or other conveyance) to be detached from the downhole tool 100 without the need for telemetry, wire-cutting operations, weak-point breaking, or the like.

The dissolvable connector 130 may be composed of, or may include, any suitable material or composition, or combinations thereof (i.e., two or more materials or compositions), known to those having ordinary skill in the art that dissolves or otherwise deteriorates when exposed to downhole conditions. For example, the material composition may be any suitable material or composition that dissolves when exposed to temperatures between −40° C. and +250° C. for a certain duration. Similarly, the material or composition may be any suitable material or composition that dissolves when exposed to pressures up to 40,000 psi (pounds per square inch) for a certain length of time.

In a similar manner, the dissolvable connector 130 may be composed of, or may include, any suitable material known to those having ordinary skill in the art that dissolves or otherwise decomposes in the presence of drilling chemicals for certain duration. For example, the material may be any suitable material that dissolves when exposed to drilling fluids, weighting materials, fluid loss additives, viscosifiers, lost circulation chemicals, stabilizing agents, flocculants, thinners and dispersants, lubricants, pipe-freeing agents, corrosion inhibitors, bactericides, scale inhibitors, emulsifiers, formation damage control chemicals, and pH control chemicals.

The duration or length of time may vary from as little as one hour to as much as a month, depending on the particular downhole operation, and the material may be selected as needed accordingly. In a specific example, the dissolvable connector 130 may release the downhole tool 100 from the tubing 118 (or wireline or other conveyance) after being exposed to water at 125° C. or above for one day (i.e., 24 hours). After this time period, the tubing 118 (or wireline or other conveyance) may be retrieved without any additional costs. The dissolvable connector 130 may then be reconstituted for future operations.

Examples of dissolvable materials that may be used as or otherwise form a part of the dissolvable connector 130 include, but are not limited to, a metal, a metal alloy, a non-metal (e.g., a plastic), a composite material, nanostructured material, or some combination thereof, and the like. Examples of suitable metals include, but are not limited to, the metals disclosed in U.S. Pat. No. 7,044,230 (see, e.g., claim 6 and dependent therefrom); U.S. Pat. No. 9,151,143 (see, e.g., claim 5), and U.S. Pat. No. 8,905,147 (see, e.g., cols. 4, 5, and 7). Other suitable materials that may be used as or otherwise form a part of the dissolvable connector 130 include, but are not limited to, a fiberglass-based material, such as materials composed of fiberglass, epoxy resin and a binding agent, similar to the materials disclosed in U.S. Pat. No. 7,168,494 (see, e.g., claim 2).

In some embodiments, the dissolvable materials may be polymers that can be deteriorated by hydrolysis. The degradability of a polymer by hydrolysis depends at least in part on its backbone structure. The rates at which such polymers deteriorate are dependent on the type of repetitive unit, composition, sequence, length, molecular geometry, molecular weight, morphology (e.g., crystallinity, spherulite size, orientation, etc.), hydrophilicity, hydrophobicity, surface area, and additives. Also, the environment to which the polymer is subjected, including temperature, the pH of aqueous well fluids, and the use of any particular enzyme helpful to the hydrolysis reaction, may affect how the material deteriorates. If the material is biodegradable, the presence of microorganisms also may affect how the material deteriorates.

When a hydrated organic or inorganic compound is used with the dissolvable polymer, the polymer may dissolve at least partially in the water provided by the hydrated organic or inorganic compound, which dehydrates over time when heated (i.e., due to exposure to the higher temperatures present at greater depths in a wellbore environment). Examples of hydrated organic or inorganic solid compounds that can be utilized with the dissolvable material include, but are not limited to, hydrates of organic acids or their salts, such as sodium acetate trihydrate, L-tartaric acid disodium salt dihydrate, sodium citrate dihydrate, hydrates of inorganic acids or their salts, such as sodium tetraborate decahydrate, sodium hydrogen phosphate heptahydrate, sodium phosphate dodecahydrate, and other hydrated organic materials, such as amylose, starch-based hydrophilic polymers, and cellulose-based hydrophilic polymers. Of these, sodium acetate trihydrate is preferred.

Other examples of polymers that are dissolvable by hydrolysis and may be used to form a least a part of the dissolvable connector 130 include, for instance, polyurethane, polyethylene glycol, polyglycolic acid, aliphatic polyesters and their derivatives. Still other suitable examples of polymers that may be used include the materials disclosed in U.S. Pat. Nos. 8,109,335 and 8,757,260 and U.S. patent application Ser. No. 10/803,668 filed on Mar. 18, 2004, and entitled "One-Time Use Composite Tool Formed of Fibers and a Degradable Resin," as well as U.S. patent application Ser. No. 10/803,689, filed on Mar. 18, 2004, and entitled "Biodegradable Downhole Tools," which are owned by the assignee hereof, and are hereby incorporated for all purposes herein by reference in their entirety. If there is any conflict in the usage or definitions of the terminology between that used herein and that incorporated by reference, the usage or definitions herein will control for all purposes herein.

Still other examples of dissolvable polymers may include homopolymers, random, block, graft, and star- and hyperbranched aliphatic polyesters. Examples of processes that may be used to prepare such polymers include polycondensation reactions, ring-opening polymerizations, free radical polymerizations, anionic polymerizations, carbocationic polymerizations, coordinative ring-opening polymerization, and any other suitable process that may be used to prepare such suitable polymers. For specific examples, the deteriorable material preferably comprises one or more compounds selected from the group consisting of: polysaccharides; chitin; chitosan; proteins; and aliphatic polyesters. Of these suitable polymers, aliphatic polyesters, such as poly(lactides), poly(glycolides), poly(glycocide-co-lactide), poly(ε-caprolactones), poly(hydroxybutyrates), poly(anhydrides), aliphatic polycarbonates, poly(orthoesters), poly(amino acids), poly(ethylene oxides), and polyphosphazenes, are preferred.

In some embodiments, one or more plasticizers may be used with the dissolvable connector 130. The plasticizers may be present in any amount that provides the desired characteristics. For example, the plasticizer discussed above provides for (a) more effective compatibilization of the melt blend components; (b) improved processing characteristics during the blending and processing steps; and (c) control and regulate the sensitivity and degradation of the polymer by moisture. To achieve pliability, the plasticizer may be present in higher amounts while other characteristics are enhanced by lower amounts. In addition, the presence of plasticizer facilitates the melt processing and enhances the degradation rate of the materials or compositions in contact with the wellbore environment. The intimately plasticized composition should be processed into a final product in a manner adapted to retain the plasticizer as an intimate dispersion in the polymer for certain properties. These can include: (1) quenching the composition at a rate adapted to retain the plasticizer as an intimate dispersion; (2) melt processing and quenching the composition at a rate adapted to retain the plasticizer as an intimate dispersion; and (3) processing the composition into a final product in a manner adapted to maintain the plasticizer as an intimate dispersion. In certain embodiments, the plasticizers are at least intimately dispersed within the aliphatic polyester.

Figure 2A:
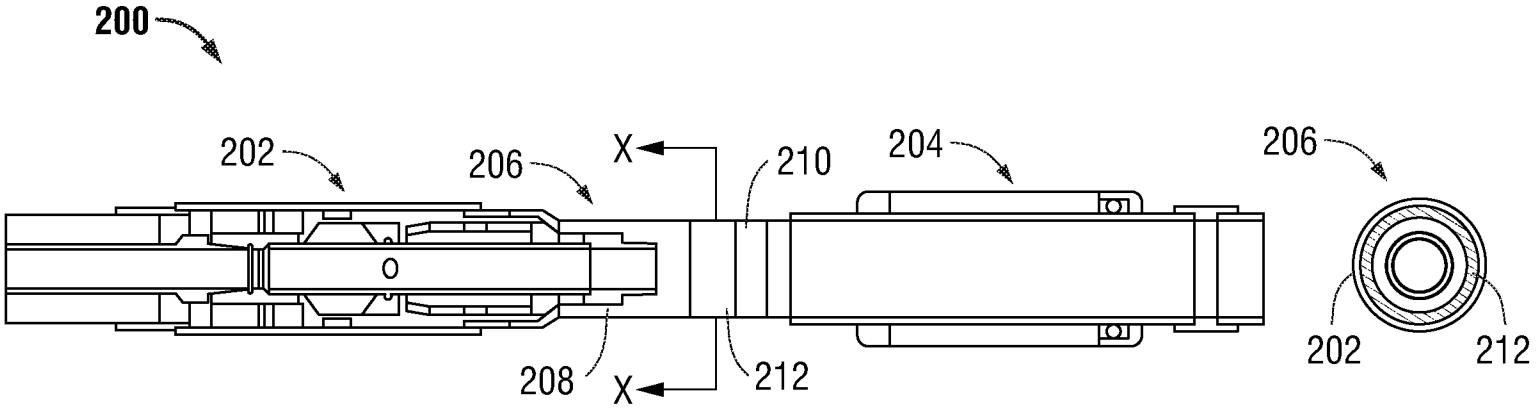
FIGS. 2A and 2B illustrate another exemplary dissolvable connector according to the disclosed embodiments.
Figure 2B:
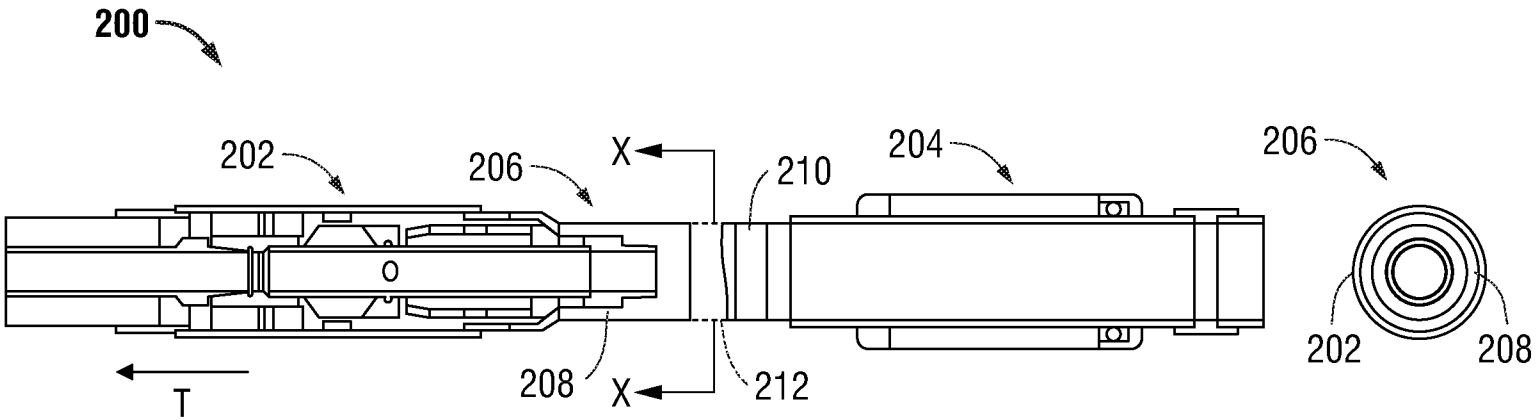

A particular implementation of the dissolvable connector disclosed herein is shown in FIG. 2, which illustrates an example of a tool string 200 that may be deployed in a wellbore, such as the wellbore 120 (see FIG. 1). The tool string 200 may be composed of multiple tools, only two of which are shown here, namely, an uphole tool 202 and a downhole tool 204. Each tool 202, 204 of the tool string 200 may include various measurement instruments and the like (not expressly shown) that are commonly used in the art. The particular types of tools 202, 204 and instruments used in the tool string 200 are not particularly important for an understanding of the disclosed embodiments and therefore a detailed description thereof is omitted here.

In accordance with the disclosed embodiments, a dissolvable connector 206 that attaches the uphole tool 202 to the downhole tool 204 is provided between the two tools. The particular dissolvable connector 206 in the example shown here has an uphole portion 208 connected to the uphole tool 202 and a downhole portion 210 connected to the downhole tool 204. The uphole portion 208 and the downhole portion 210 are designed to engage with their respective tools 202, 204 and are typically made of steel or similar material not normally considered to be dissolvable. A dissolvable middle portion 212 is then provided in between the uphole portion 208 and the downhole portion 210 to join the two portions together.

In general operation, the dissolvable middle portion 212 is made of a material that is able to retain its physical size and shape for a specified length of time downhole. The shape of the dissolvable middle portion 212 in this example is cylindrical based on the generally cylindrical shape of the connector 206. This generally cylindrical shape can be seen in the cross-sectional view of the connector 206 along line X-X on the right side of FIG. 2A. Other shapes and configurations (e.g., rectangular, rod-shaped, etc.) may of course be used for the connector 206 and the dissolvable middle portion 212 therein without departing from the scope of the disclosed embodiments.

Ideally, the entire tool string 200 may be retrieved from the wellbore upon completion of the operation, but sometimes the tool string 200 may become stuck in the wellbore. When this happens, the tool string 200 may be left in place until after the specified wait time has elapsed and the dissolvable middle portion 212 begins to dissolve and deteriorate. Once the middle portion 212 is dissolved or at least partially dissolved, the uphole portion 208 and the downhole portion 210 may be separated from each other by applying a tension force T on the uphole portion 208. This can be seen in the cross-sectional view of the connector 206 on the right side of FIG. 2B, where the dissolvable middle portion 212 is shown in dotted lines to indicate it has dissolved or at least partially dissolved. At this point, the uphole tool 202 (and the uphole portion 208 connected thereto) may be detached from the downhole tool 204 (and the downhole portion 210 connected thereto) and returned to the surface 105. The uphole tool 202 may then be processed and reused as needed, while the downhole tool 204 is left downhole, for example, to be drilled out.

In some embodiments, the length of the wait time may be selected as needed based on the dissolvable material used in the dissolvable connector 206 and the chemical and physical threshold conditions of the downhole environment to which the material may be exposed, as explained above. Thus, different downhole environments may require the use of different dissolvable materials for the middle portion 212 to achieve the same (or different) wait times. As well, when there are three or more tools on the tool string 200, a separate dissolvable connector 206 may be provided for the various tools. The tools are typically, but not necessarily, connected in serial fashion and each dissolvable connector 206 may have the same or a different type of dissolvable material therein. The latter allows for different tools to be detached from the tool string 200 at different times based on exposure to substantially the same chemical and physical threshold conditions. As well, each dissolvable connector 206 may also release based on different threshold conditions. For example, one dissolvable connector 206 may dissolve at high temperature, while another dissolvable connector 206 may dissolve due to high pressure, and the like.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device, which functions to block fluid flow within a tubular, such as a tubing string, or within an annulus. The blockage of fluid flow prevents the fluid from flowing across the isolation device in any direction and thereby isolating the zone of interest. As used herein, the relative term "downstream" means at a location further away from a wellhead. By isolating certain zones in this manner, treatment techniques can be performed within a zone of interest.

Common isolation devices include, but are not limited to, a ball and seat, a packer, a plug, a bridge plug, and a wiper plug device. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping the ball from the wellhead onto the seat that is located within the wellbore. The ball engages with the seat, and the seal created by this engagement prevents fluid communication into other zones downstream of the ball and seat.

A bridge plug is composed primarily of slips, a plug mandrel, and a rubber sealing element. The bridge plug can be introduced into a wellbore and the sealing element can be caused to block fluid flow into downstream zones. A packer generally consists of a sealing device, a holding or setting device, and an inside passage for fluids. The packer can be used to block fluid flow through the annulus located between the outside of a tubular and the wall of the wellbore or inside of a casing.

In general operation, these isolation devices are conveyed into the wellbore using a wireline, tubing string, or similar conveyance and left in place. Once in place, a command is sent via the conveyance to release the isolation device, and the conveyance is retrieved and removed from the wellbore. If the release fails and the conveyance remains attached to the isolation device, expensive and time-consuming interventions are needed to retrieve the conveyance. Alternatively, depending on the type of conveyance used, it may be more economical to consider the conveyance as lost and subsequently drill it out along with the isolation device.

Figure 3A:
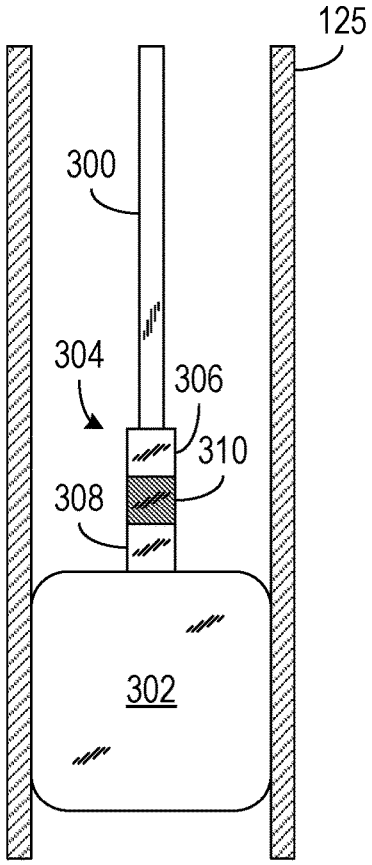
FIGS. 3A, 3B, and 3C illustrate an exemplary dissolvable connector according to the disclosed embodiments.
Figure 3B:
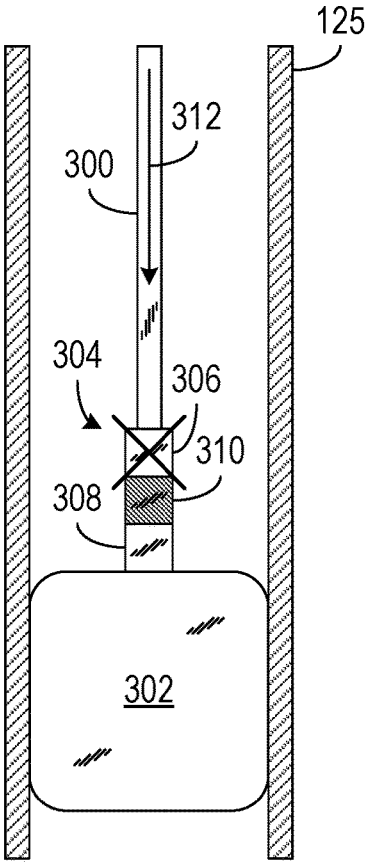
Figure 3C:
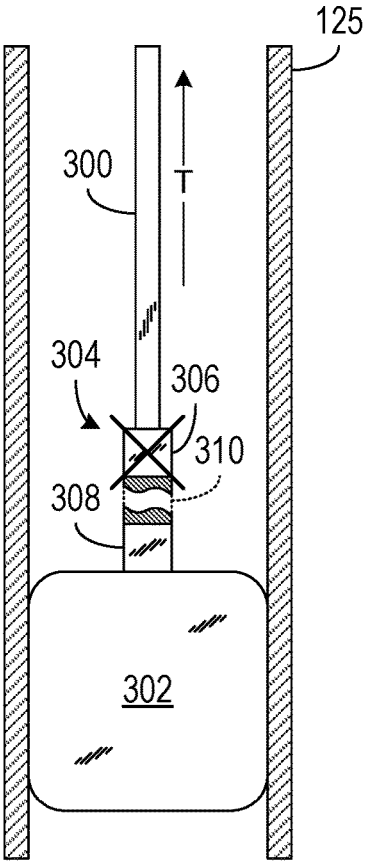

In accordance with the disclosed embodiments, as shown in FIGS. 3A, 3B, and 3C, a dissolvable connector may be used with the isolation device to facilitate retrieval of the conveyance in the event of a release failure. As can be seen, a wireline conveyance 300 is used to lower an isolation device, such as a smart plug 302, into position within a wellbore casing 125. A dissolvable connector 304 connects the smart plug 302 to the wireline conveyance 300. The particular dissolvable connector 304 in this example has an uphole portion 306 attached to the wireline conveyance 300 and a downhole portion 308 attached to the smart plug 302. As with the dissolvable connector from FIG. 2, the uphole portion 306 and the downhole portion 308 shown here are configured to engage the wireline conveyance 300 and the smart plug 302, respectively, and are typically made of steel or similar material not generally considered to be dissolvable. A dissolvable middle portion 310 is then provided in between the uphole portion 306 and the downhole portion 308 to join the two portions together.

In some embodiments, the uphole portion 306 may be a release mechanism 306 that is capable of detaching from the wireline conveyance 300 upon receipt of a release command (e.g., an electrical signal). Any suitable release mechanism known to those having ordinary skill in the art may be used as the release mechanism 306, including an electrical, mechanical, chemical, electrochemical, or electromechanical release mechanism, without departing from the scope of the disclosed embodiments.

In general operation, the smart plug 302 is placed downhole by the wireline conveyance 300 and used as a top plug for a cementing job, for example, as depicted in FIG. 3A. Once the cement job is complete and the operator wishes to retrieve the wireline conveyance 300, he/she may cause a signal 312 to be sent via the wireline conveyance 300 to actuate the release mechanism 306, as depicted in FIG. 3B. In the present example, the release mechanism 306 has failed, as indicated by the "X" displayed over the mechanism.

Rather than write off the wireline conveyance 300 as lost or attempt an expensive recovery operation, the operator may simply wait a certain amount of time until the dissolvable middle portion 310 begins to dissolve and deteriorate. The length of the wait time may be selected as needed based on the type of material used for the dissolvable middle portion 310 and the chemical and physical conditions of the downhole environment. Once the dissolvable middle portion 310 is dissolved or at least partially dissolved, the uphole portion 306 may be easily separated from the downhole portion 308 by applying a tension force T on the uphole portion 306, as depicted by the dotted lines in FIG. 3C, and the wireline conveyance 300 may be recovered to the surface.

Figure 4A:
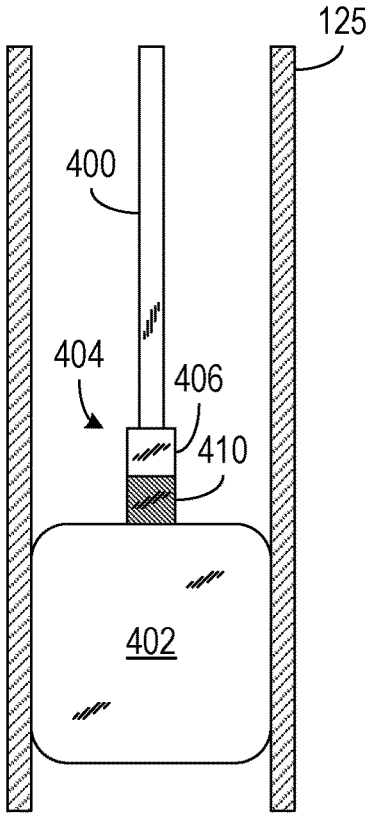
FIGS. 4A, 4B, and 4C illustrate yet another exemplary dissolvable connector according to the disclosed embodiments.
Figure 4B:
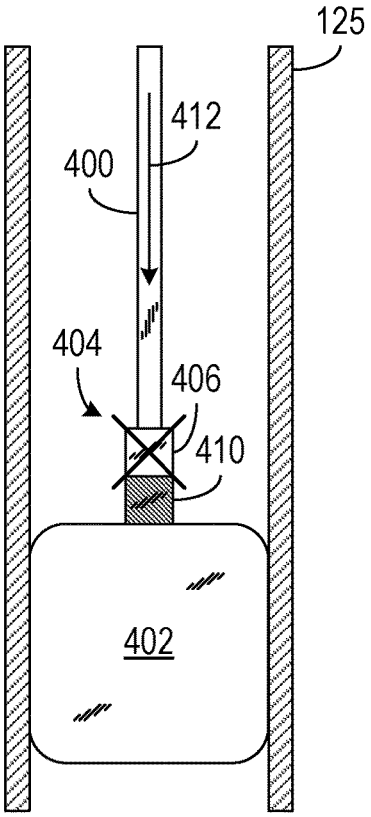
Figure 4C:
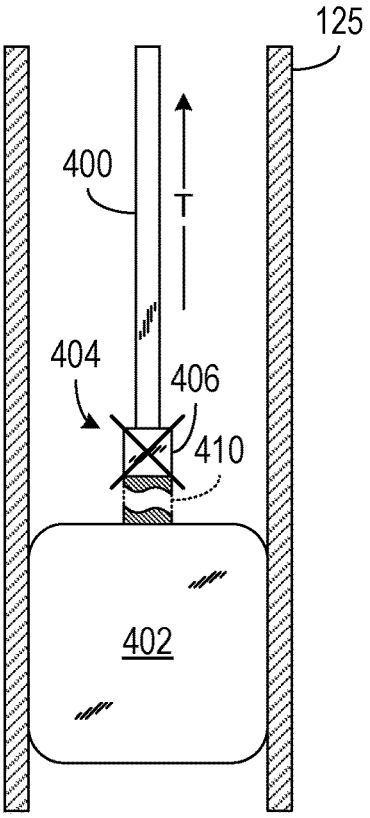

FIGS. 4A, 4B, and 4C illustrate an alternative dissolvable connector that may be used with an isolation device (or other devices) to facilitate retrieval of a conveyance in the event of a release failure. In this embodiment, a wireline conveyance 400 is again used to lower an isolation device, such as a smart plug 402, into position within the wellbore casing 125. A dissolvable connector 404 connects the smart plug 402 to the wireline conveyance 400. However, the dissolvable connector 404 in this example only has an uphole portion 406 and a dissolvable downhole portion 410. The uphole portion 406 and the dissolvable downhole portion 410 shown here are configured to engage the wireline conveyance 400 and the smart plug 402, respectively, with the uphole portion 406 being made of steel or similar material not generally considered to be dissolvable. In some embodiments, the uphole portion 406 may be any suitable release mechanism known to those having ordinary skill in the art.

Operation of the embodiment shown in FIGS. 4A, 4B, and 4C is essentially the same as operation of the embodiment shown in FIGS. A, 3B, and 3C. Basically, when an operator wishes to retrieve the wireline conveyance 400 from the casing 125, he/she may cause a signal 412 to be sent via the wireline conveyance 400 to actuate the release mechanism 406, as depicted in FIG. 4B. If the release mechanism 406 fails, as indicated by the "X" displayed over the mechanism, the operator may simply wait a certain amount of time until the dissolvable downhole portion 410 begins to dissolve and deteriorate. Once the dissolvable downhole portion 410 is dissolved or at least partially dissolved, the uphole portion 406 and the downhole portion 410 may be separated by applying a tension force T, as depicted in FIG. 4C. The wireline conveyance 400 may thereafter be brought up to the surface.

Figure 5A:
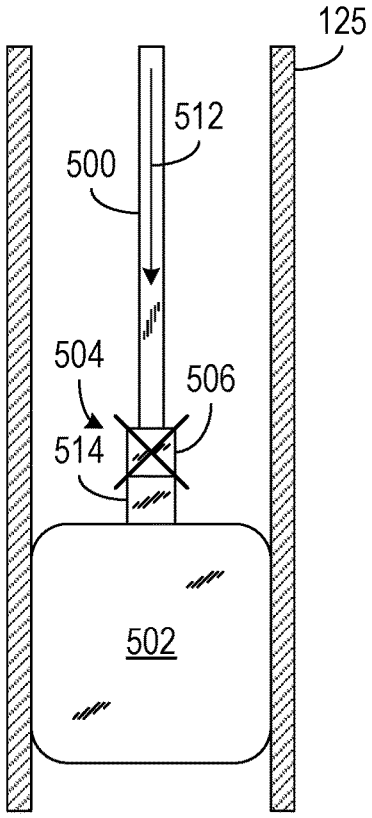
FIGS. 5A, 5B, and 5C illustrate an exemplary dissolvable connector having a dissolvable sheath according to the disclosed embodiments.
Figure 5B:
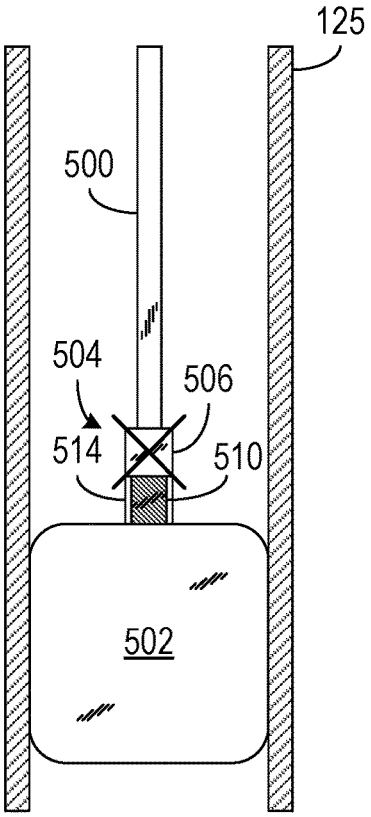
Figure 5C:
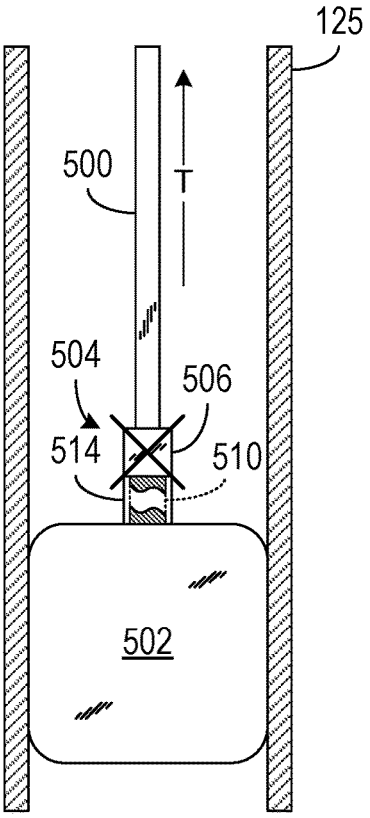

FIGS. 5A, 5B, and 5C illustrate yet another alternative dissolvable connector that may be used with an isolation device (or other devices) to facilitate retrieval of a conveyance in the event of a release failure. In this embodiment, a wireline conveyance 500 is again used to lower an isolation device, such as a smart plug 502, into position within the wellbore casing 125. A dissolvable connector 504 again connects the smart plug 502 to the wireline conveyance 500. The dissolvable connector 504 includes an uphole portion 506 and a dissolvable downhole portion 510. The uphole portion 506 and the dissolvable downhole portion 510 shown here are again configured to engage the wireline conveyance 500 and the smart plug 502, respectively. In some embodiments, the uphole portion 506 may again be any suitable release mechanism known to those having ordinary skill in the art.

In addition to the uphole portion 506 and the dissolvable downhole portion 510, the dissolvable connector 504 in this example also includes a protective layer 514 around part of the connector 504, preferably around the dissolvable downhole portion 510. The protective layer may resemble a sheath 514 and may be made of a metal, a metal alloy, a plastic, a composite material, nanostructured material, electrical, mechanical, and optical braids, or some combination thereof, and the like. Or the protective sheath 514 may be a second (or third, fourth, etc.) layer of the same material as the dissolvable downhole portion 510. Then, under appropriate conditions, the sheath 514 may be dissolved, destroyed, or otherwise removed to expose the dissolvable downhole portion 510 enclosed therein.

As used above, the term "metal alloy" means a mixture of two or more elements, wherein at least one of the elements is a metal. The other element(s) may be a non-metal or a different metal. An example of a metal and non-metal alloy is steel, comprising the metal element iron and the non-metal element carbon. An example of a metal and metal alloy is bronze, comprising the metallic elements copper and tin. Additionally, while the foregoing discussion refers to metals or metal alloys, it is readily apparent that any suitable material, including thermoplastics and composites, that can be dissolved by a suitable medium, may be used instead of metals or metal alloys. An acid or other suitable dissolution medium may also be used. As used herein, the phrase "dissolution medium" means a substance, for example, a fluid or solvent that is capable of undergoing a chemical reaction and dissolving a material. The reaction is typically a chemical reaction. As used herein, the term "dissolve" means decomposition, degradation, melting, eating away, disintegration or corrosion of the material.

In general operation, when an operator wishes to retrieve the wireline conveyance 500 from the casing 125, he/she may cause a signal 512 to be sent via the wireline conveyance 500 to actuate the release mechanism 506, as depicted in FIG. 5A. When the release mechanism 506 fails, as indicated by the "X" displayed over the mechanism, the operator may unsheathe the protective sheath 514 (i.e., remove or otherwise allow it to be removed). This unsheathing of the sheath 514 exposes the dissolvable downhole portion 510 to the conditions in the downhole environment, as depicted in FIG. 5B. The operator may then wait until the dissolvable downhole portion 510 dissolves sufficiently so that the uphole portion 506 and the downhole portion 510 are no longer joined, as depicted in FIG. 5C. The wireline conveyance 500 may thereafter be brought up to the surface.

The presence of the protective sheath 514 thus provides increased control over when the dissolvable downhole portion 510 begins to degrade. For example, the sheath 514 may be used to protect the dissolvable downhole portion 510 from the downhole environment until it is actually needed. This prevents the dissolvable downhole portion 510 from dissolving prematurely, for example, where there is an intervening zone in the wellbore that may dissolve an exposed dissolvable downhole portion 510 before the smart plug 502 can reach the desired zone. The protective sheath 514 also allows the dissolvable connector 504 to be reused for multiple operations, for example, if no condition activated the unsheathing of the protective sheath 514.

In some embodiments, the protective sheath 514 may be opened or unsheathed passively. For example, a pressure difference may cause a buoyant sheath to rise up, a temperature change may cause a latch to release or a spring to push open the sheath. Alternatively, the protective sheath 514 may be opened or unsheathed actively, such as by tension, dissolution, or telemetry signals to actuate the sheath. For example, a command signal may be sent from the surface via the wireline conveyance 500 or from a downhole tool through a tension gauge to unsheathe the sheath 514. Other examples of types and amounts of tension, dissolution, and telemetry signals may be found in U.S. Pat. Nos. 7,093,664; 8,109,335; and 8,757,260. Where dissolution is used (i.e., as in the case of a dissolvable sheath), the protective sheath 514 may be opened or unsheathed by one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

Note in the foregoing embodiments that the uphole portion is sometimes described as being a release mechanism. Those having ordinary skill in the art will understand of course that it is also possible for the downhole portion to be the release mechanism. In some embodiments, it is also possible to fashion the release mechanism or a portion thereof out of dissolvable material so that the dissolvable portion also doubles as the release mechanism. In the latter case, the uphole portion and/or the downhole portion may not be needed, as the dissolvable portion itself may serve as the entire dissolvable connector.

Figure 6:
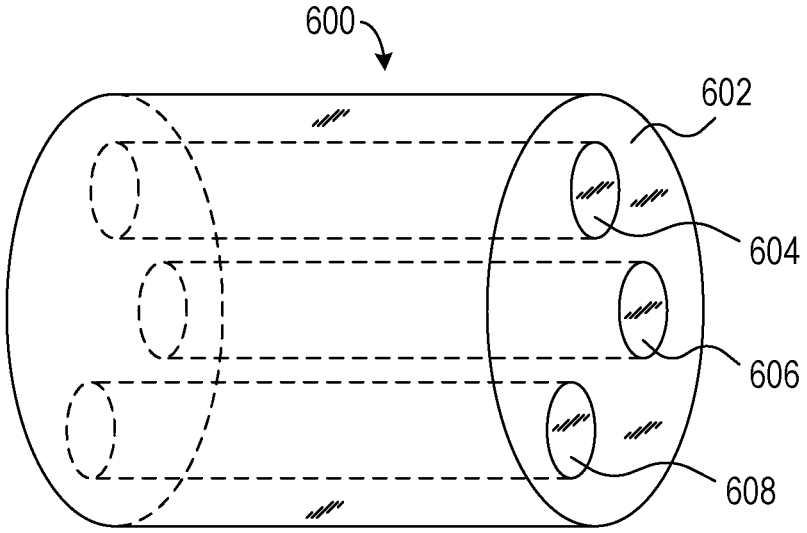
FIG. 6 illustrates an exemplary dissolvable connector having dissolvable and non-dissolvable components according to the disclosed embodiments.

Turning now to FIG. 6, another exemplary dissolvable connector is shown at 600 according to the embodiments disclosed herein. In this embodiment, the dissolvable connector 600 is a cylindrical connector having a non-dissolvable body 602 and one or more dissolvable components 604, 606, and 608 disposed therein. The dissolvable components 604, 606, and 608 are also cylindrical in this embodiment and are also parallel to the non-dissolvable body 602. Those having ordinary skill in the art will understand that other shapes, orientations, and sizes may be used for the non-dissolvable body 602 and/or the dissolvable components 604, 606, and 608 without departing from the scope of the disclosed embodiments. For example, in some embodiments, the dissolvable components 604, 606, and 608 may be rectangular and/or perpendicular to the non-dissolvable body 602, which may also be rectangular in some embodiments. As well, the dissolvable components 604, 606, and 608 may all be made of the same dissolvable material in some embodiments, or one or more of the dissolvable components 604, 606, and 608 may be made of a different dissolvable material in some embodiments.

Accordingly, as set forth above, the embodiments disclosed herein may be implemented in a number of ways. For example, in general, in one aspect, the disclosed embodiments relate to a dissolvable connector for use downhole in a wellbore. The dissolvable connector comprises, among other things, at least one connector portion connectable to a first device disposed in the wellbore, the at least one connector portion composed of a dissolvable material. The dissolvable material dissolves at least partially when exposed to a threshold environmental condition in the wellbore to release the first device from a second device.

In accordance with any one or more of the disclosed embodiments, the at least one connector portion comprises first and second connector portions and at least one of the connector portions is composed of a dissolvable material that dissolves at least partially when exposed to a threshold environmental condition in the wellbore.

In accordance with any one or more of the disclosed embodiments, the first device is one of a frac plug, a cement plug, an electric submersible pump, a perforating gun, a set packer, a gravel pack screen, a bottom hole assembly, or fishing equipment, and the second device is one of a cable, a wire, a wireline, a slickline, an e-line, a drill string, a cable tubing, a production tubing, a casing string, or a fiber cable.

In accordance with any one or more of the disclosed embodiments, the dissolvable material comprises dissolvable and non-dissolvable components.

In accordance with any one or more of the disclosed embodiments, the threshold environment condition includes one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

In accordance with any one or more of the disclosed embodiments, a protective sheath is disposed around at least a part of the connector.

In accordance with any one or more of the disclosed embodiments, the protective sheath comprises at least one layer composed of one or more of a metal, a metal alloy, a plastic, a composite material, a ceramic, nano-structured material, an electric braid, an optical braid, or a mechanical braid.

In accordance with any one or more of the disclosed embodiments, the protective sheath is configured to be removed from around the connector by one of tension, dissolution or a telemetry signal.

In accordance with any one or more of the disclosed embodiments, the dissolution of the sheath occurs based on one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

In general, in another aspect, the disclosed embodiments relate to a method of detaching a device in a wellbore. The method comprises, among other things, attaching the device to a connector composed of dissolvable material that dissolves at least partially when exposed to a threshold environmental condition in the wellbore, and conveying the device and the connector into the wellbore using a conveyance. The connector detaches the device from the conveyance when the threshold environmental condition in the wellbore is reached.

In accordance with any one or more of the disclosed embodiments, the device is one of a frac plug, a cement plug, an electric submersible pump, a perforating gun, a set packer, a gravel pack screen, a bottom hole assembly, or fishing equipment.

In accordance with any one or more of the disclosed embodiments, the conveyance is one of a cable, a wire, a wireline, a slickline, an e-line, a drill string, a cable tubing, a production tubing, a casing string, or a fiber cable.

In accordance with any one or more of the disclosed embodiments, the dissolvable material comprises dissolvable and non-dissolvable components.

In accordance with any one or more of the disclosed embodiments, the threshold environment condition includes one or more of a threshold exposure to temperature, a threshold exposure to pressure, a threshold length of time, a threshold exposure to drilling chemicals, a threshold exposure to water, a threshold exposure to hydrogen, a threshold exposure to caustic chemicals, or combinations thereof.

In accordance with any one or more of the disclosed embodiments, the comprising conveying a second device attached to a second connector into the wellbore using the conveyance, the second connector composed of a second dissolvable material that dissolves at least partially when exposed to a second threshold environmental condition in the wellbore to detach the second device from the conveyance.

In accordance with any one or more of the disclosed embodiments, the first threshold environmental condition is the same as the second threshold environmental condition. Alternatively, the first threshold environmental condition may be different from the second threshold environmental condition in some embodiments.

In accordance with any one or more of the disclosed embodiments, a protective sheath is disposed around a part of the connector, the protective sheath comprising at least one layer composed of one or more of a metal, a metal alloy, a plastic, a ceramic, a composite material, nano-structured material, an electric braid, an optical braid, or a mechanical braid.

In accordance with any one or more of the disclosed embodiments, the protective sheath is removed from around the connector by one of tension, dissolution, or a telemetry signal.

In accordance with any one or more of the disclosed embodiments, the dissolution of the sheath occurs based on one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

The foregoing descriptions of specific embodiments of the disclosed embodiment have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

The invention claimed is:

1. A dissolvable connector for use downhole in a wellbore, comprising:

at least one connector portion connectable to a first device disposed in the wellbore, the at least one connector portion composed of a dissolvable material;

wherein the dissolvable material dissolves at least partially when exposed to a threshold environmental condition in the wellbore to release the first device from a second device, wherein the dissolvable material comprises at least two dissolvable components that are independent from one another and dissolvably attachable to the first device and a non-dissolvable component encompassing the at least two dissolvable components, wherein the at least two dissolvable components include differing materials, wherein the at least two dissolvable components comprise a first dissolvable component comprising a first longitudinal axis and a second dissolvable component comprising a second longitudinal axis that is different from the first longitudinal axis, and wherein the first longitudinal axis and the second longitudinal axis are positionable parallel to each other and to a third longitudinal axis of the non-dissolvable component.

2. The dissolvable connector of claim 1, wherein the at least one connector portion comprises first and second connector portions and at least one of the connector portions is composed of a dissolvable material that dissolves at least partially when exposed to the threshold environmental condition in the wellbore.

3. The dissolvable connector of claim 2, wherein the first device is one of a frac plug, a cement plug, an electric submersible pump, a perforating gun, a set packer, a gravel pack screen, a bottom hole assembly, or fishing equipment, and the second device is one of a cable, a wire, a wireline, a slickline, an e-line, a drill string, a cable tubing, a production tubing, a casing string, or a fiber cable.

4. The dissolvable connector of claim 1, wherein the threshold environment condition includes one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

5. The dissolvable connector of claim 4, further comprising a protective sheath disposed around at least a part of the connector.

6. The dissolvable connector of claim 5, wherein the protective sheath comprises at least one layer composed of one or more of a metal, a metal alloy, a plastic, a composite material, a ceramic, nano-structured material, an electric braid, an optical braid, or a mechanical braid.

7. The dissolvable connector of claim 6, wherein the protective sheath is configured to be removed from around the connector by one of tension, dissolution or a telemetry signal.

8. The dissolvable connector of claim 7, wherein dissolution of the sheath occurs based on one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

9. A method of detaching a device in a wellbore, comprising:

attaching the device to a connector composed of dissolvable material, wherein the dissolvable material comprises at least two dissolvable components that are independent from one another and dissolvably attached to the device and a non-dissolvable component encompassing the at least two dissolvable components, and wherein at least a portion of the at least two dissolvable components dissolve partially when exposed to a threshold environmental condition in the wellbore, and the at least two dissolvable components of the dissolvable material dissolve at different rates when exposed to the threshold environmental condition in the wellbore; and conveying the device and the connector into the wellbore using a conveyance;

wherein the connector detaches the device from the conveyance when the threshold environmental condition in the wellbore is reached, wherein the at least two dissolvable components comprise a first dissolvable component comprising a first longitudinal axis and a second dissolvable component comprising a second longitudinal axis that is different from the first longitudinal axis, and wherein the first longitudinal axis and the second longitudinal axis are positioned parallel to each other and to a third longitudinal axis of the non-dissolvable component.

10. The method of claim 9, wherein the device is one of a frac plug, a cement plug, an electric submersible pump, a perforating gun, a set packer, a gravel pack screen, a bottom hole assembly, or fishing equipment.

11. The method of claim 9, wherein the conveyance is one of a cable, a wire, a wireline, a slickline, an e-line, a drill string, a cable tubing, a production tubing, a casing string, or a fiber cable.

12. The method of claim 9, wherein the threshold environment condition includes one or more of a threshold exposure to temperature, a threshold exposure to pressure, a threshold length of time, a threshold exposure to drilling chemicals, a threshold exposure to water, a threshold exposure to hydrogen, a threshold exposure to caustic chemicals, or combinations thereof.

13. The method of claim 9, further comprising conveying a second device attached to a second connector into the wellbore using the conveyance, the second connector composed of a second dissolvable material that dissolves at least partially when exposed to a second threshold environmental condition in the wellbore to detach the second device from the conveyance.

14. The method of claim 13, wherein the threshold environmental condition is the same as the second threshold environmental condition.

15. The method of claim 13, wherein the threshold environmental condition is different from the second threshold environmental condition.

16. The method of claim 9, further comprising disposing a protective sheath around a part of the connector, the protective sheath comprising at least one layer composed of one or more of a metal, a metal alloy, a plastic, a ceramic, a composite material, nano-structured material, an electric braid, an optical braid, or a mechanical braid.

17. The method of claim 16, further comprising removing the protective sheath from around the connector by one of tension, dissolution, or a telemetry signal.

18. The method of claim 17, wherein dissolution of the sheath occurs based on one or more of a threshold exposure to temperature, a threshold exposure to pressure, a threshold length of time in the wellbore, a threshold exposure to drilling chemicals, a threshold exposure to water, a threshold exposure to hydrogen, a threshold exposure to caustic chemicals, or combinations thereof.

* * * * *